US008943990B2

(12) United States Patent
McQuade

(10) Patent No.: US 8,943,990 B2
(45) Date of Patent: Feb. 3, 2015

(54) RETRACTABLE SHALLOW WATER ANCHOR APPARATUS, AND METHODS OF CONSTRUCTING AND UTILIZING SAME

(71) Applicant: Max Edward McQuade, Greencastle, PA (US)

(72) Inventor: Max Edward McQuade, Greencastle, PA (US)

( * ) Notice: Subject to any disclaimer, the term of this patent is extended or adjusted under 35 U.S.C. 154(b) by 103 days.

(21) Appl. No.: 13/655,608

(22) Filed: Oct. 19, 2012

(65) Prior Publication Data

US 2014/0109817 A1 Apr. 24, 2014

Related U.S. Application Data

(60) Provisional application No. 61/610,442, filed on Mar. 13, 2012.

(51) Int. Cl.
*E02B 3/24* (2006.01)

(52) U.S. Cl.
USPC ..... 114/230.16; 440/6

(58) Field of Classification Search
USPC ..... 440/6; 114/230.16
IPC ..... E02B 3/24; B63H 20/007
See application file for complete search history.

(56) References Cited

U.S. PATENT DOCUMENTS

| | | | | |
|---|---|---|---|---|
| 4,830,382 | A * | 5/1989 | Wheeler | 473/492 |
| 5,062,376 | A | 11/1991 | Tremblay | |
| 5,129,345 | A * | 7/1992 | Senften | 114/144 E |
| 6,041,730 | A | 3/2000 | Oliverio et al. | |
| 7,921,794 | B1 | 4/2011 | Cullom et al. | |
| 2009/0223430 | A1 | 9/2009 | Kuenzel | |
| 2009/0293793 | A1 * | 12/2009 | Silver | 114/294 |
| 2011/0209653 | A1 * | 9/2011 | Bernloehr et al. | 114/230.13 |
| 2011/0209656 | A1 | 9/2011 | Bernloehr et al. | |
| 2011/0259256 | A1 | 10/2011 | Grady | |

FOREIGN PATENT DOCUMENTS

| | | | |
|---|---|---|---|
| CN | 2643056 | Y | 9/2004 |
| CN | 201056287 | Y | 5/2008 |
| JP | 3677032 | B9 | 5/2005 |

* cited by examiner

*Primary Examiner* — Stephen Avila
(74) *Attorney, Agent, or Firm* — Weiner & Burt, P.C.; Irving M. Weiner; Pamela S. Burt

(57) ABSTRACT

A retractable shallow water anchor system that mounts onto the trolling motor on a boat. The anchor system does not stick up above the top of the trolling motor. When the motor is pulled up or put down, the anchor system travels with it. With the trolling motor down, the user removes the rope from the cleat on the anchor system and two fiberglass rods extend out (extend to 7-8 ft.) to anchor the boat in place. The unit is made of aluminum, stainless steel, and fiberglass.

1 Claim, 2 Drawing Sheets

RETRACTABLE SHALLOW WATER ANCHOR APPARATUS, AND METHODS OF CONSTRUCTING AND UTILIZING SAME

CROSS-REFERENCE TO RELATED APPLICATIONS

The present application claims priority from U.S. Provisional Patent Application 61/610,442 filed Mar. 13, 2012.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The present invention relates to a novel and unique retractable shallow water anchor apparatus, and methods of constructing and utilizing same.

More particularly, the present invention relates to a novel and unique retractable shallow water anchor apparatus which includes telescoping anchor members, and methods of constructing and utilizing same.

It is a desideratum of the present invention to avoid the animadversions of conventional devices and techniques, and at the same time to provide a very convenient and unique retractable shallow water anchor apparatus.

SUMMARY OF THE INVENTION

The present invention provides a retractable shallow water anchor apparatus comprising: a telescoping anchor; means for connecting said anchor to a trolling motor; and means for selectively lowering the anchor and retracting the anchor.

The present invention also provides a retractable shallow water anchor apparatus, comprising: a telescoping anchor; first means for releaseably connecting said telescoping anchor to a trolling motor; and second means for selectively extending said telescoping anchor and forretracting/collapsing said telescoping anchor.

It is a primary object of the present invention to provide a retractable shallow water anchor apparatus as described hereinabove including an elongated member movably disposed internally of said telescoping anchor.

Another object of the invention is to provide an apparatus as described hereinabove including a rope or other flexible member which is disposed internally of the telescoping anchor.

A further object of the present invention is to provide a retractable shallow water anchor apparatus as described hereinabove wherein: said telescoping anchor comprises a plurality of telescoping members including an upper member, a lower member, and one or more intermediate members; and said movable elongated internal member is affixed to said lower member of said telescoping anchor.

A further object of the present invention is to provide a retractable shallow water anchor apparatus as described hereinabove including: a motor mount for said trolling motor; and wherein said telescoping anchor is selectively and releaseably connected to a shaft of said trolling motor above said motor mount and below said motor mount.

A further object of the present invention is to provide a retractable shallow water anchor apparatus as described hereinabove including: a cleat attached to said telescoping anchor; and wherein an upper portion of said movable elongated internal member is removably and selectively connected to said cleat.

A further object of the present invention is to provide a retractable shallow water anchor apparatus as described hereinabove wherein said telescoping anchor is connected to said trolling motor in such a fashion that when said trolling motor is pulled up or put down, said telescoping anchor travels with said trolling motor.

Other objects, advantages, and features of the present invention will become apparent to those persons skilled in this particular area of technology and to other persons after having been exposed to the present patent application when read in conjunction with the accompanying patent drawings.

DETAILED DESCRIPTION OF THE INVENTION

With reference to the drawings, there is shown a retractable shallow water anchor apparatus 10 which attaches to the trolling motor 11 on the front of a fishing boat 12 in accordance with a preferred embodiment of the invention.

Figure 1:
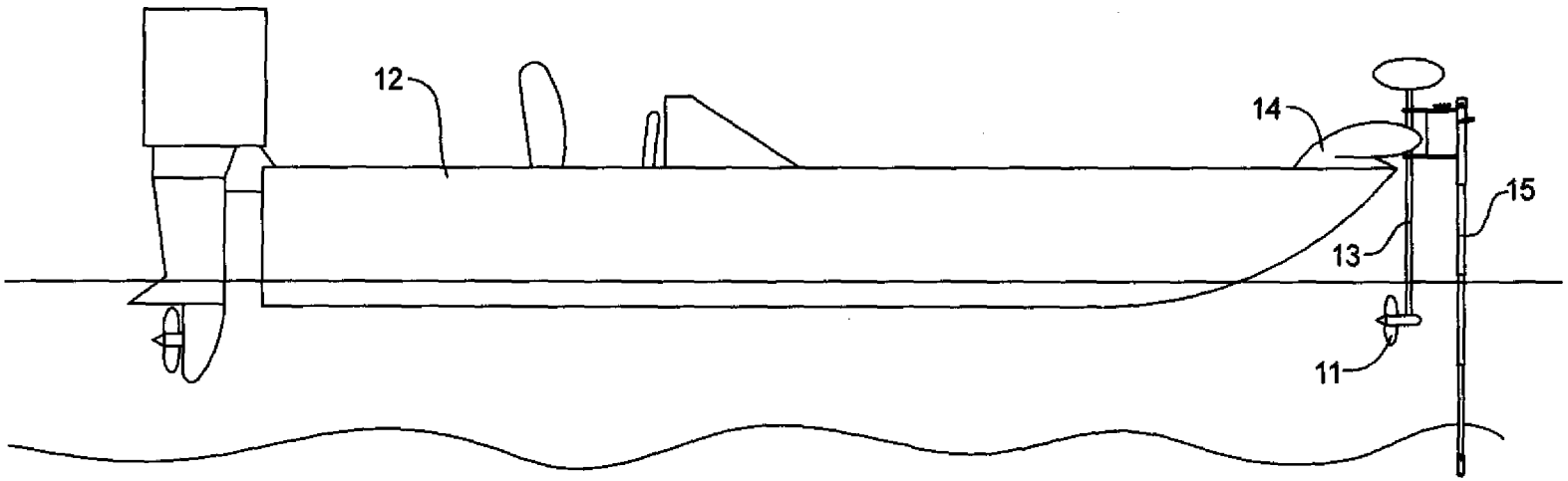
FIG. 1 shows a preferred embodiment of the apparatus attached to a boat.

As shown in FIG. 1, the retractable shallow water anchor apparatus 10 is selectively and releaseably connected to the shaft 13 of the trolling motor 11.

The trolling motor 11 is connected to a trolling motor mount 14 connected to the front of the boat 12.

The anchor apparatus 10 includes a retractable anchor 15, a flat planar member 16, upper and lower connection devices 17 and 18, a rope 19, a rope handle 20, and a cleat 21 for the rope 19.

The anchor 15 includes an upper member 22, three telescoping poles 23, 24 and 25, and a lower member 26. The lower member 26 is heavier than pole 23, 24 or 25.

The upper member 22 and three telescoping poles 23, 24 and 25 are provided with an internal, central, axial tubular aperture within which the rope 19 is disposed.

One end of the rope 19 is affixedly pinned internally to the lower member 26.

The other end of the rope 19 is secured to the handle 20.

The upper portion of the rope 19 may be removably and selectively secured to the cleat 21.

Figure 2:
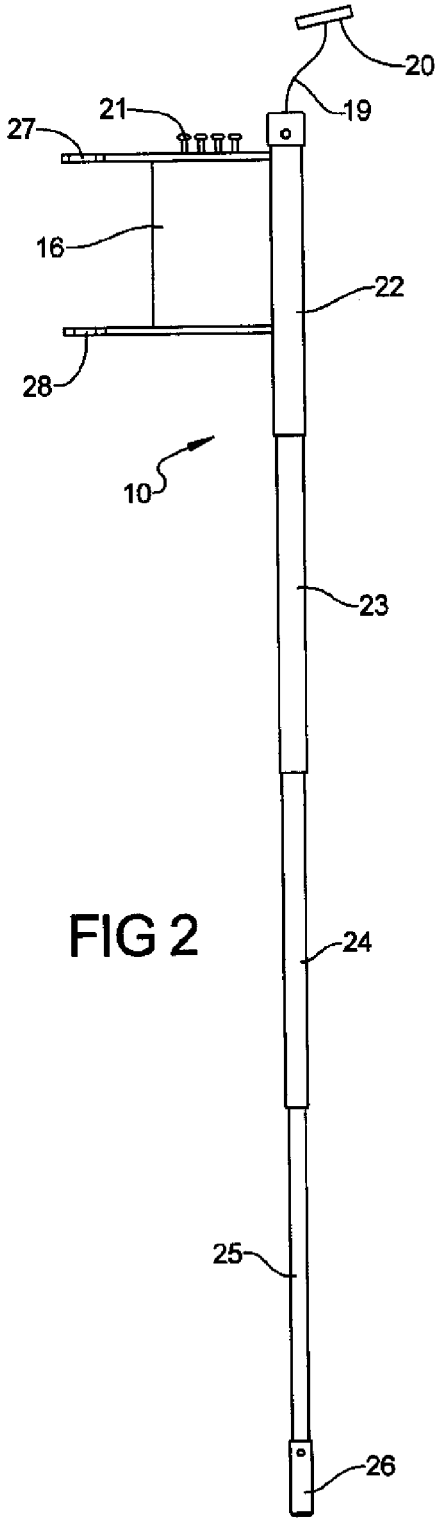
FIG. 2 shows the anchor of the FIG. 1 apparatus in a fully extended position.

FIG. 2 shows the anchor 15 fully extended.

Figure 3:
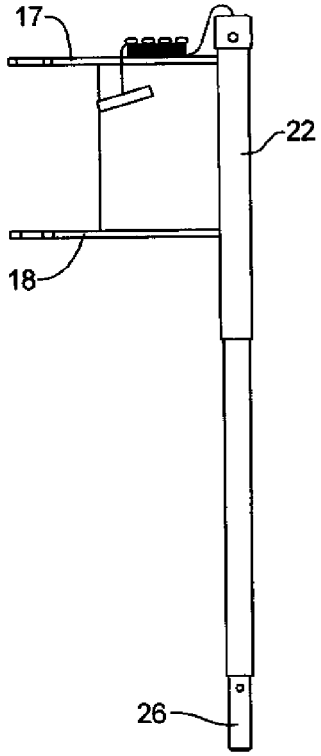
FIG. 3 shows the anchor fully retracted.

FIG. 3 shows the anchor 15 fully retracted.

Figure 4:
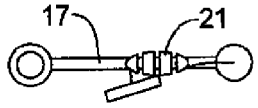
FIG. 4 shows a top plan view of the upper connection device.

With reference to FIG. 4, there is shown a top plan view of the upper connection device 17 and the cleat 21 for the rope 19.

Two round clamps 27 and 28 adjacent the flat planar member 16 have two bolts that when removed half of the clamp comes apart so it can be mounted to the trolling motor 11 by replacing the half clamp and re-installing the two bolts per.

The clamps 27 and 28 attach the anchor apparatus 10 to the trolling motor 11, one clamp 27 above the trolling motor mount 14, and one clamp 28 below the trolling motor mount 14.

The cleat 21 mounted above the member 16 holds the rope 19 which raises the shallow water anchor 15

When the rope 19 is removed from the cleat 21, the anchor 15 will go down to approximately seven to eight feet to hold the boat 12 in place.

When the rope 19 is pulled up, the telescoping members 23, 24 and 25 come up with the rope 19.

Then the rope 19 can be tied to the cleat 21 as illustrated in FIG. 3.

Then the boat 12 can be moved with the trolling motor 11, or the trolling motor 11 can be pulled up at which time the anchor apparatus 10 will come up and lie in the boat 12 along with the trolling motor 11.

Thus, the apparatus 10 mounts onto the trolling motor 11, but does not protrude above the top of the trolling motor 11.

When the trolling motor 11 is pulled up or put down, the anchor apparatus 10 travels with it.

With the trolling motor 11 in the down position, the rope 19 is removed from the cleat 21 permitting the fiberglass telescoping sections 23, 24 and 25 to extend downwardly urged by the downward motion of the heavier lower member 26 to anchor the boat 12.

The components of the anchor apparatus 10 can be fabricated from any suitable materials, such as, for example, aluminum, stainless steel, fiberglass, etc.

There has been illustrated in the accompanying drawings and described hereinabove only one possible preferred embodiment of the present invention which can be practiced and constructed in many different embodiments, configurations, materials, arrangements of components, sizes, and shapes.

It should be understood that many changes, modifications, variations, and other uses and applications will become apparent to those persons skilled in this particular area of technology and to others after having been exposed to the present patent specification and accompanying drawings.

Any and all such changes, modifications, variations and other uses and applications which do not depart from the spirit and scope of the present invention are therefore covered by and embraced within the patent claims set forth hereinbelow.

The invention claimed is:

1. A retractable shallow water anchor apparatus, comprising, in combination:

a telescoping anchor;

first means for releaseably connecting said telescoping anchor to a trolling motor;

second means for selectively extending said telescoping anchor and for retracting/collapsing said telescoping anchor;

an elongated member movably disposed internally of said telescoping anchor;

said movable elongated member is a rope;

a cleat attached to said telescoping anchor;

an upper portion of said movable elongated internal member is removably and selectively connected to said cleat;

said telescoping anchor comprises a plurality of telescoping members including an upper member, a lower member, and one or more intermediate members;

said movable elongated internal member is affixed to said lower member of said telescoping anchor;

a motor mount for said trolling motor;

said telescoping anchor is selectively and releaseably connected to a shaft of said trolling motor above said motor mount and below said motor mount; and said telescoping anchor is connected to said trolling motor in such a fashion that when said trolling motor is pulled up or put down, said telescoping anchor travels with said trolling motor.

* * * * *